US005353576A

United States Patent [19]

Palamides et al.

[11] Patent Number: 5,353,576

[45] Date of Patent: Oct. 11, 1994

[54] DEVICE FOR PACKAGING PRINTED MATTER

[76] Inventors: Sesto Palamides, Weissenburgstrasse 20, D-7000 Stuttgart 1; Aldo Palamides, Dornierstrasse 16, D-7253 Renningen 1; Stefano Palamides, Weissenburgstrasse 20, D-7000 Stuttgart 1, all of Fed. Rep. of Germany

[21] Appl. No.: 283,198

[22] Filed: Dec. 12, 1988

[30] Foreign Application Priority Data

Dec. 17, 1987 [DE] Fed. Rep. of Germany ..... 3742787

[51] Int. Cl.[5] ..... B65B 35/50; B65B 35/56; B65B 63/02

[52] U.S. Cl. ..... 53/540; 53/528; 53/544; 414/790.5; 414/791.2

[58] Field of Search ..... 53/143, 528, 540, 544, 53/586, 590; 414/788.3, 790.5, 791.2, 907

[56] References Cited

U.S. PATENT DOCUMENTS

| | | | |
|---|---|---|---|
| 3,343,334 | 9/1967 | Bode et al. | 53/590 X |
| 3,991,541 | 11/1976 | Eijsermans | 53/586 X |
| 3,991,542 | 11/1976 | White et al. . | |
| 4,250,692 | 2/1981 | Uchida | 53/586 X |
| 4,264,255 | 4/1981 | Saro et al. | 414/788.3 |
| 4,276,736 | 7/1981 | Haberstroh et al. . | |
| 4,457,656 | 7/1984 | Kosina et al. | 414/790.5 X |
| 4,466,227 | 8/1984 | Hanscom | 53/590 X |
| 4,547,112 | 10/1985 | Steinhart | 414/788.3 |
| 4,657,465 | 4/1987 | Aoki | 414/907 X |
| 4,725,180 | 2/1988 | Kasamatsu et al. | 414/788.3 |
| 4,805,383 | 2/1989 | Allwein | 53/586 X |

FOREIGN PATENT DOCUMENTS

| | | | |
|---|---|---|---|
| 0113874 | 12/1983 | European Pat. Off. | B65B 27/08 |
| 0243944 | 4/1987 | European Pat. Off. | B65B 31/10 |
| 1223294 | 9/1963 | Fed. Rep. of Germany . | |
| 3238994 | 10/1982 | Fed. Rep. of Germany | B65B 27/08 |
| 3346168 | 12/1983 | Fed. Rep. of Germany | B65B 35/50 |
| 8611717 | 4/1986 | Fed. Rep. of Germany | B65B 25/14 |
| WO81/03315 | 5/1981 | PCT Int'l Appl. | B65B 27/08 |

*Primary Examiner*—Robert L. Spruill
*Assistant Examiner*—Linda B. Johnson
*Attorney, Agent, or Firm*—Poms, Smith, Lande & Rose

[57] ABSTRACT

Copies (22) of preferably folded or stitched printed matter are transferred by means of a loading device (20) from a preceding station to a stacking device (30). The copies (22) are stacked in the stacking means (30) into stacks (120), positioned on a bottom (96). The bottom (96) can be lowered together with the stack (120) lying thereon. During this movement, the bottom is lowered simultaneously into a banding means (106) which applies itself to the bottom and the side walls of the stack. Thereafter the banding means (106) is closed tightly on top of the lowered stack (120), by means of sealing rams (118). The stack (120), with the loop wrapped around it, is then carried off, and the lowered bottom (96) or its partial bottoms (98, 100) return to their upper position.

10 Claims, 6 Drawing Sheets

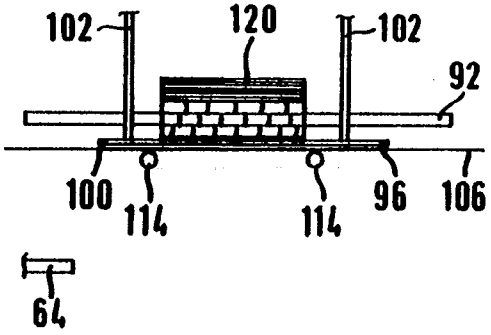
Fig. 3a
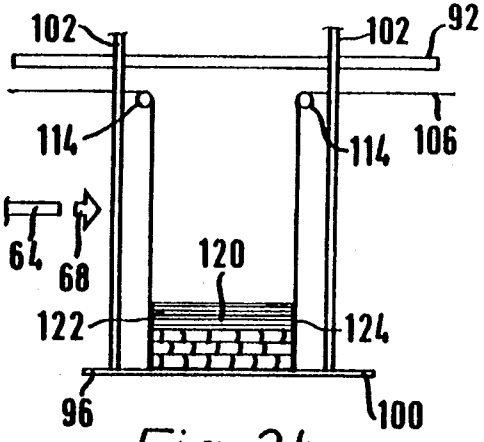
Fig. 3b
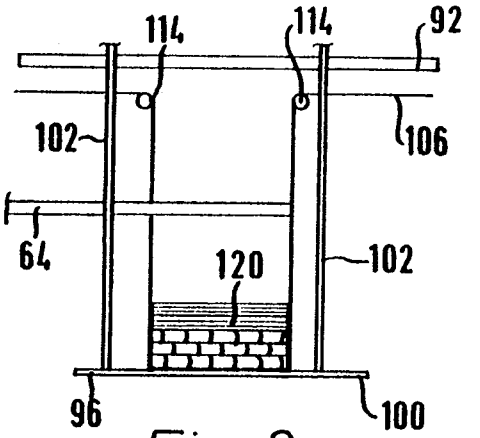
Fig. 3c
Fig. 3d
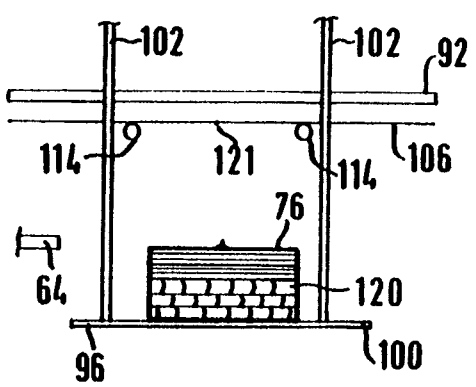
Fig. 3e
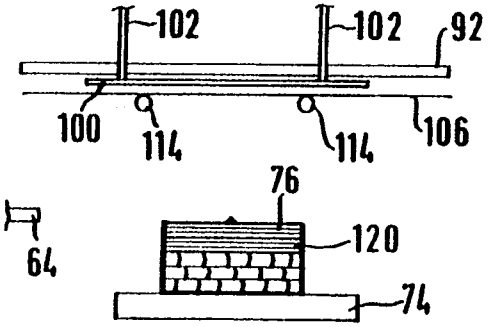
Fig. 3f

DEVICE FOR PACKAGING PRINTED MATTER

The present invention relates to a device for packaging preferably folded, glued or stitched copies of printed matter, comprising loading means for receiving the copies which arrive from a preceding station, stacking means following the loading means provided with lateral guides by which the stacks are held in position so that they cannot get dislodged horizontally, and banding means for banding said stack.

The invention is further directed to a method for packaging printed matter comprising the steps of receiving copies of the preferably folded, glued or stitched printed matter arriving from a preceding station, by means of a loading device, and supplying them to a stacking device where the individual copies are aligned and counted; scaling up the individual copies in the loading device; and transferring the copies, after they have been formed by the stacking device into a stack that cannot get dislodged in the horizontal direction, to the packaging unit where they are enclosed by a banding means while they are still in the compressed condition.

A method and an apparatus or device of this type have been known from German utility model No. G 86 11 717.

The known packaging system is used for aligning, scaling-up, stacking and packaging printed matter after the latter has passed stitching or folding machines. Several individual devices form one packaging system.

The loose copies are fed in the form of a scaled-up flow along a conveyor belt of the loading device and supplied to the stacking means. The copies are withdrawn one by one from the scaled-up flow, aligned and counted, and stacked in a stacking device. The copies so separated from the scaled-up flow drop into the stacking device, due to their force of gravity, where they are retained by lateral guides so that they cannot get dislodged horizontally. The bottom of the stacking device is provided with a protective plate on which the first copy is placed. Depending on the height of the stack to be formed, another protective plate is inserted after a predetermined number of copies, which then receives the next copies. Finally, another protective plate is placed on the uppermost copy of the stack. The stacking device itself is arranged on a circular table. Once a stack has been completed in the stacking device, i.e. once the upper-most protective plate has been applied, the circular table is rotated about a predetermined angular value until the stacking device comes to rest adjacent a banding device provided at the periphery of the circular table. During the banding process, the stack is initially pressed vertically, and than banded by a banding element. After completion of the banding process, the finished, sealed stack remains positioned in the stacking means. The rotary table is turned once more about an angular value in the same direction as before. At the end of this movement, the stacking means occupies a discharge position in which the packaged stacks can be removed from the stacking device. Another turning movement of the rotary table, in the same direction, brings the empty stacking device once more in alignment with the loading device so that it is again ready for receiving the next copies from the scaled-up flow.

It is a drawback of devices of this type, and of the packaging process performed in this manner, that due to the physical separation of the three partial devices and the partial process steps performed thereby, i.e. stacking and transferring the stack thereafter to the banding device, pressing, banding and transferring the stack thereafter to the discharge station, discharging the stack and subsequent return to the stacking device, the total system and method get rather space-consuming and time-consuming, respectively. Now, it is the object of the present invention to improve a device and a method for packaging printed matter of the type described above in such a manner that the stacking and banding processes can be carried out simply and in a space-saving manner.

This object is achieved by a device wherein said stacking means comprises a bottom which is adapted for being lifted and/or lowered vertically and on which the copies can be stacked, said bottom is provided with an opening exposing at least that bottom area of a lowermost copy of the stack where the banding element is to be applied, and wherein said banding means is arranged immediately below the stacking means.

Due to the fact that the bottom of the stacking means can be lowered vertically, and at the same time immersing said stack in said banding element of said banding means arranged immediately below the bottom, the transfer of the stacks to said banding means is implemented in an extremely space-saving manner. After having been lowered, the stack enters the banding element immediately, i.e. the transfer motion as such is already the beginning of the banding process so that no dead times are encountered for transfer movements to the different processing stations. By providing the opening in the bottom of the stacking device, which opening must correspond at least to the width of the banding element, it is no longer necessary to lift the stack off the bottom; rather, the banding element can be wrapped around while the stack remains in place on the bottom. The stack to be packaged at any time has to be lifted only so far that the banding element can be closed on top of the uppermost copy of the stack. During this operation, the loop of the banding element wrapped around the stack is cut off the remaining supply of the banding element so that the latter is permitted to return to its original position. The stack having a band or tape applied around it is then lifted or pushed off the bottom of the stacking device, without the need to move or turn the latter once more, whereafter the bottom is lifted to its upper position ready for receiving new copies. The partial process steps are carried out in device sections arranged one below the other and following each other without any interruption which makes their design simple and extremely clear. The lowering bottom of the stacking device constitutes at the same time a working part of the banding means as due to its lowering movement, with the copies positioned on the bottom, the banding element is applied around the bottom and the two lateral walls of the partial stack so that no elements moving around the stack are required for positioning the banding element. One obtains in this manner a packaging device of particularly simple construction which uses only a small number of components. In addition, it is thus possible to push the finished stack out of the device, in a direction opposite to the direction of the scaled-up flow of copies arriving on the loading device, and this operation can be carried out immediately below the loading device whereby an extremely space-saving structure can be obtained. When such a U-shaped design is used, the finished stacks can be returned to a position close to the starting point of the loading device. It is then possible, for example, to place the individual copies of one lot on the loading device and to receive them later, in the form of a finished stack, at the same, only a little lower, position.

This solves the object underlying the present invention fully and perfectly. According to one preferred embodiment of the invention, the stacking means is provided with a base plate that can be turned horizontally by 180° and which accommodates the bottom, for rotation therewith.

This feature provides the advantage that the stacking means can operate as a so-called cross-stacker, which means that the individual copies, or partial stacks, can be turned alternately by 180° during stacking. This leads to level stacks, in particular when stacking folded sheets which tend to result in unequal stacking heights in the area of the folds. The lowering bottom, as part of the base plate of the cross-stacker, can be turned together with the base plate and can then be lowered to the banding device after a sufficient number of copies has been stacked.

According to a preferred embodiment of the invention, the bottom is provided with two level-equalizing bottom parts held in place by carrier means mounted for vertical adjustment in the base plate.

This feature provides the advantage that by selecting the size of the two bottom halves the opening in the bottom between the two halves can be adapted especially to the packaging element used, i.e. a chord, a narrow or a wide film tape.

According to another embodiment of the invention, the bottom can be lowered by means of a pressing device adapted for being applied upon the uppermost copy of the stack.

This feature provides the advantage that the device serving for lowering the bottom exerts at the same time a pressure upon the stack positioned on the bottom whereby the stack assumes the compressed condition desirable for the banding operation. Consequently, here again one device is used for performing two process steps or two partial processes, i.e. the steps of transferring and lowering and of compressing the stack, whereby a particularly simple device and/or a particularly simple method is provided within the scope of the object underlying the invention.

According to another embodiment of the invention, the banding element is closed tightly by means of two closing rams arranged laterally of the stack and adapted for moving across the top of the stack. This feature provides the advantage that the vertical space below the bottom is free from any closing elements during the displacement proper and that the banding element has to be introduced into, and then retracted from the space on top of the uppermost copy of the stack only for the closing operation.

According to another embodiment of the invention, movable angle rails are provided on the bottom for defining the corners of the square stack. By providing the bottom with these lateral supports, which have been known as such, the stack of copies is retained in position against horizontal displacement. And the possibility to displace the rails enables the latter to be adapted to different copy sizes.

According to another embodiment of the invention, the bottom can be lowered to a point sufficiently low to enable a pressing device arranged laterally thereof to be moved across the top face of the uppermost copy of the stack, whereafter the bottom can be lifted to a position where the respective stack is held between the advanced pressing device and the bottom, at a predetermined pressure, and that the banding element is closed in this compressed condition of the stack. Arranging the pressing device laterally in this manner provides the advantage that the vertical space above the bottom of the stacking means is not obstructed by the pressing device during the stacking and lowering operations and that the pressing device is introduced into this space only after lowering of the bottom, with the stack positioned thereon. By lifting the bottom subsequently, the stack is then pressed against the stationary pressing device. Accordingly, the bottom acts in this manner additionally as a member of the pressing device which contributes towards rendering the device particularly simple.

According to another embodiment of the invention, the bottom is connected via four vertical rods which are provided with a drive and which form the corners of a rectangle, with the loading device ending at one side of the rectangle and the copies being transferred from the loading device into a partial stack-forming device provided approximately at the same level and above the stacking device, whereafter the partial stacks are deposited by the partial stack-forming device on the bottom of the base plate of a cross-stacker which is arranged for being turned by 180°.

This feature provides the advantage that the lowering and lifting devices for the bottom are given a particularly simple and sturdy design. Due to the fact that the copies are transferred initially from the loading device to a partial stack-forming device, the stacking device arranged vertically below thereof can be turned during each such operation by 180° before receiving a partial stack from the partial stack-forming device. In addition, a partial stack can be pre-formed in the partial stack-forming device while the bottom is lifted from its lowered position to its upper-most position after a finished stack has been released and removed, so that once the bottom has reached its upper-most position it is immediately ready for receiving a partial stack.

The invention will now be described and explained in more detail by way of certain selected embodiments of the invention and with reference to the attached drawings in which.

Figure 1:
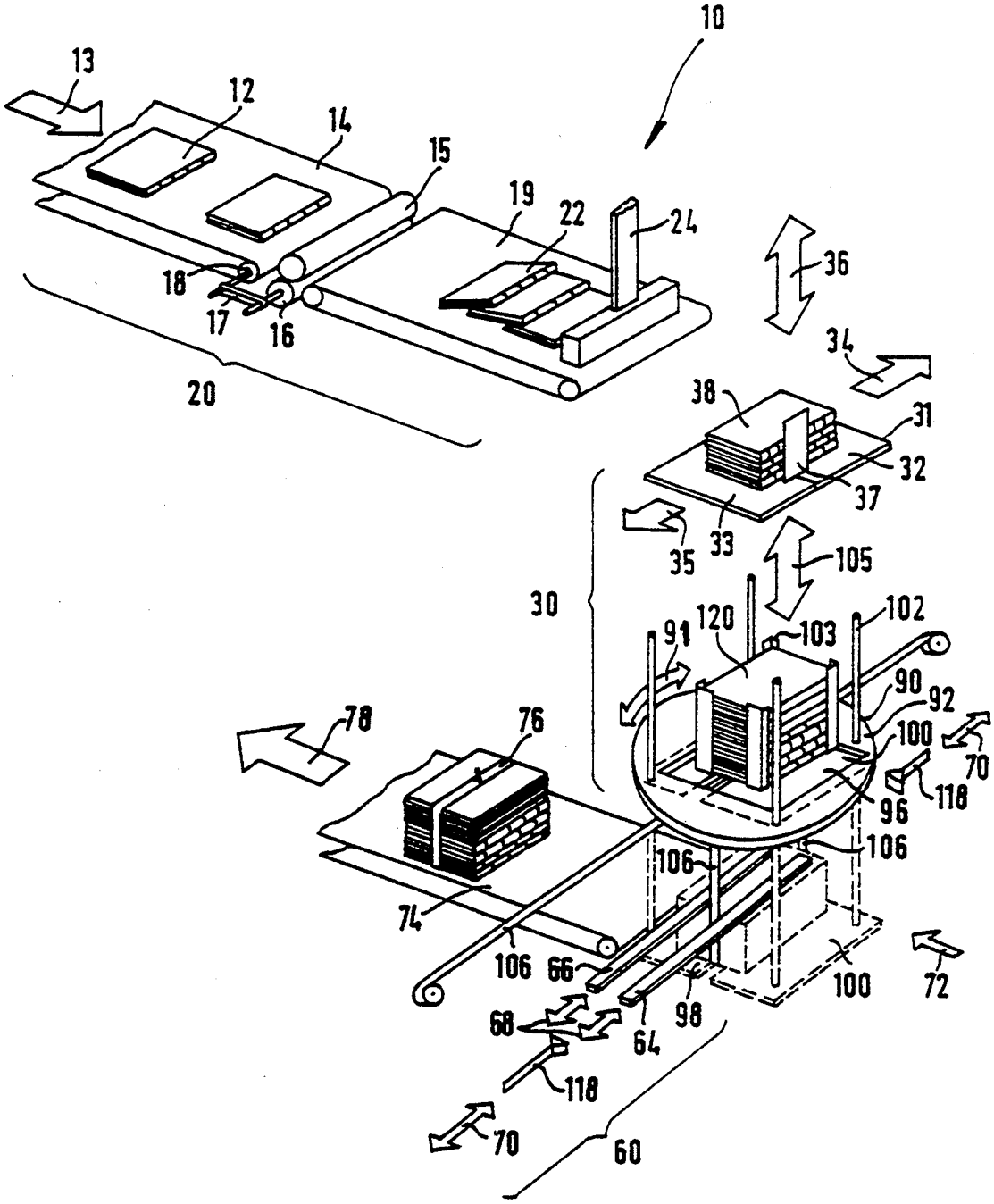
FIG. 1 shows a very diagrammatic view of a packaging device according to the invention illustrating the method according to the invention.
Figure 2:
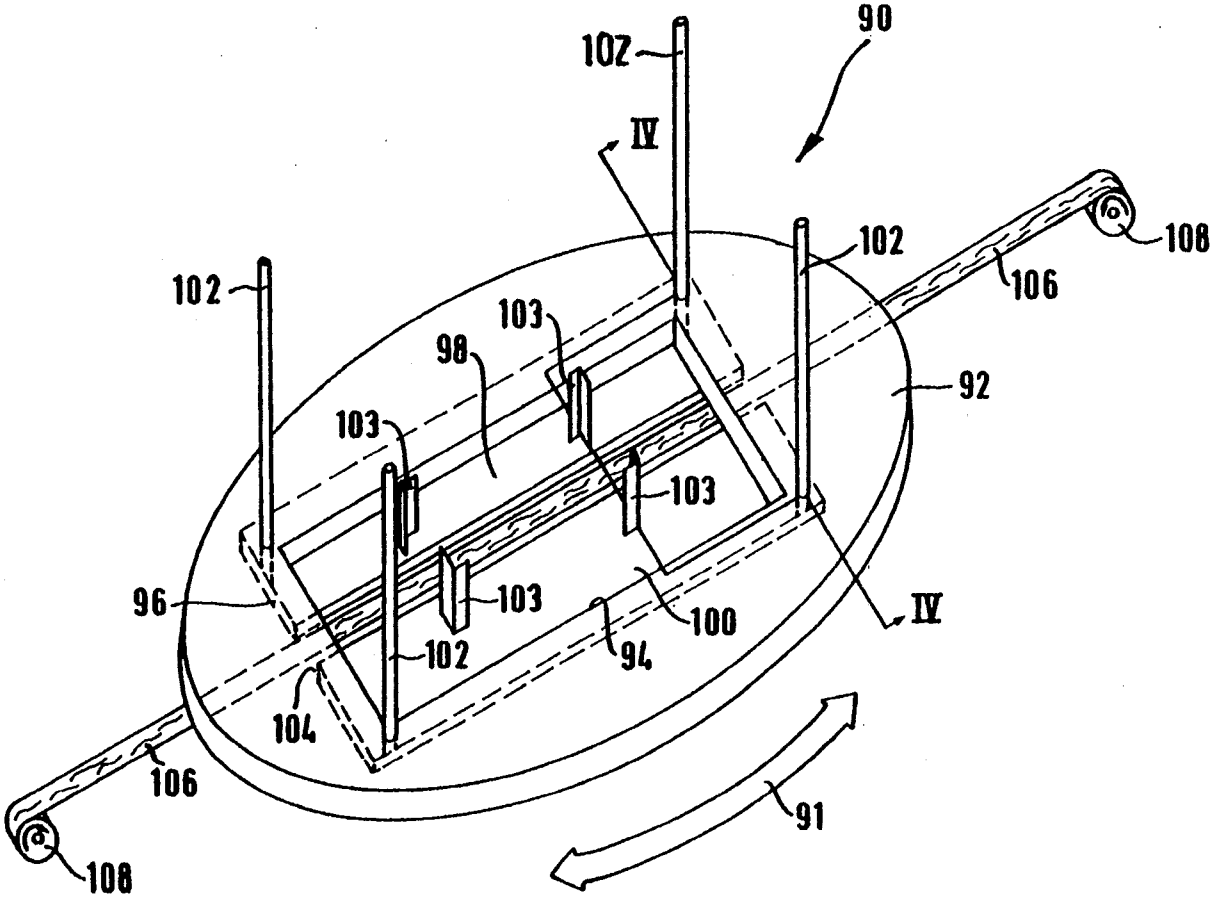
FIG. 2 shows a very diagrammatic enlarged view of part of the device according to FIG. 1.
Figure 4:
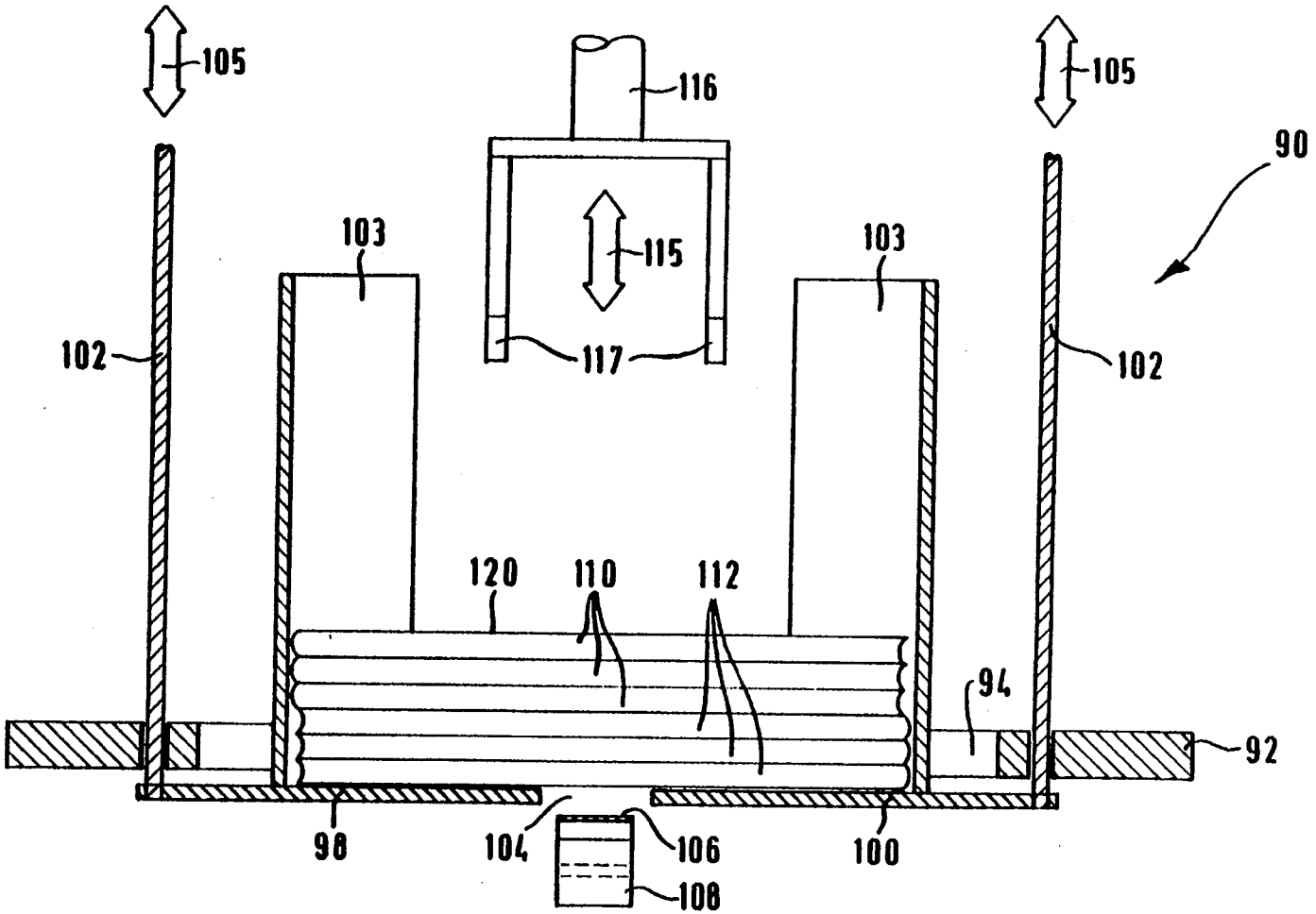

FIGS. 3*a* to 3*f* show diagrammatic views of a sequence of operating steps performed by the device according to FIG. 1;

FIG. 4 shows a section along line IV—IV in FIG. 2, showing in addition stacked copies and a pressing device; and FIGS. 5 to 8 show diagrammatic views similar to those of FIGS. 3*a* to 3*f* of the variant shown in FIG. 4, in different operating positions.

FIG. 1 shows in very diagrammatic form a packaging device 10 according to the invention composed by a loading device 20, a stacking device 30 and a banding device 60 forming together one unit.

The loading device 20 comprises a first and a second conveyor belt 14, 19 with a press consisting of two rollers 15, 16 arranged therebetween. The lower roller 16 of the pair of rollers 15, 16 of the press is connected, via a belt 17, with a return roller 18 of the conveyor belt 14, the return roller 18 serving as driving means for the synchronous movement of the rollers 15, 16 and 18 as well as the conveyor belt 14.

The conveyor belt 14 carries copies 12 which arrive from a preceding station and are transported in the direction indicated by arrow 13. The copies 12 are delivered by the conveyor belt 14 to a position between the pair of rollers 15, 16 for being compressed. Thereafter, they are carried off the pair of rollers 15, 16 as compressed copies 22, still positioned on the conveyor belt 19. This compressing operation is carried out in particular when folded copies are processed because copies which have been folded from a single sheet tend to unfold again, at least partially. If such unfolding sheets were stacked or scaled-up later, a very high, unequal stack would be obtained.

At the end of the conveyor belt 19, which moves in the same direction as the conveyor belt 14, a piling ram 24 is arranged which, in the representation of FIG. 1, is lowered approximately to the surface of the conveyor belt 19 so that the compressed copies 22 carried on the conveyor belt 19 are formed into a scaled-up flow.

Viewed in the feeding direction of the conveyor belt 19, one can see a partial stack-forming device 31 of the stacking means 30 arranged immediately behind the piling ram 24 for receiving the scaled-up compressed copies 22 in case the piling ram 24 should be lifted. The partial stack-forming device 31 is provided with a stop 37. The copies 22 arriving from the conveyor belt 19 abut against the stop 37 whereby a partial stack 38 is formed. By keeping the piling ram 24 in the raised position for a predetermined period of time it is possible to let a desired number of copies 22 pile up in the partial stack-forming device 31.

The partial stack-forming device 31 can be displaced vertically, as indicated by arrow 36, and comprises a bottom composed of two parts 32 and 33.

The parts 32, 33 can be lifted or lowered in the directions indicated by arrow 36, via piston-and-cylinder units not shown in the drawing. In addition, they can be moved away from each other, as indicated by arrows 34 or 35 in the drawing.

The bottom parts 32, 33 of the bottom of the partial stacking device 31 are arranged in substantially aligned position above a bottom 96 of a rotary basket 90 of the stacking device 30 so that when the parts 32, 33 are moved apart in the direction indicated by arrows 34, 35 a partial stack 38 positioned on them will drop upon the bottom 96 of the rotary basket 90.

The rotary basket 90 can be turned by 180°, as indicated by arrow 91 so that the partial stacks 38 arriving from the partial stack-forming device 31 can be received by it in positions turned alternately by 180°.

The rotary basket 90 which is shown in enlarged scale in FIG. 2, comprises a base plate 92 provided with a rectangular central opening 94.

A bottom 96 arranged below the base plate 92 comprises a first bottom part 98 and a second bottom part 100.

Each of the bottom parts 98, 100 is connected with two rods 102 which are passed through the base plate 92 and held therein for vertical displacement.

The bottom parts 98, 100 are of rectangular shape and have a length slightly greater than that of the rectangular opening 94. In the central area of the rectangular opening 94, they are spaced from each other so that a clear space 104 is provided.

The distance between the two end faces of the bottom parts 98, 100 facing each other and defining the space 104 corresponds at least to the width of a film tape 106 intended to be wrapped around the stacks 120 to be packaged.

Each of the bottom faces of the bottom parts 98, 100 is provided with two angle rails 103 (see also FIG. 1) which are aligned in such a manner as to enclose the corner edges of the copies to be packaged, i.e. to define the corner edges of a cuboid body. The arrangement of the angle rails 103 is such that the partial stacks (38) dropping from the partial stack-forming device 31 fit exactly between them (see FIG. 1).

The angle rails 103 are adjustable, i.e. displaceable, so that they can be adjusted to different copy sizes.

Below the free space 104 formed between the two bottom parts 98, 100 (see FIG. 2), one can see a banding means 106 in the form of a film tape of the banding device 60 which projects beyond the two sides of the base plate 92 and is wound up on rollers 180 turning in opposite directions.

The rollers 108 are provided with tensioning means not shown in the drawing, which tend to keep the tape in stretched condition.

In the position illustrated in FIGS. 1 and 2, the bottom 96 occupies its uppermost position, just below the base plate 92 of the rotary basket 90.

For wrapping the stack 120 with the band or the film tape 106, the bottom 96 of the rotary basket 90 can be lowered.

The exact procedural steps as well as the design and operation of the components of the banding device will be described in more detail in connection with FIGS. 3*a* to 3*f*.

FIGS. 3*a* to 3*f* show a diagrammatic representation of a detail of the packaging device 10 shown in FIG. 1, in the area of the rotary basket, viewed in the direction of arrow 72.

FIG. 3*a* corresponds to the upper position of the bottom 96 which is illustrated in FIG. 1 by full lines. For clarity's sake, the angle rails 103 have been omitted in the diagrammatic representations of FIGS. 3*a* to 3*f*. One can see in the representation of FIGS. 3*a* to 3*f* the bottom part 100 of the bottom 96. The copies positioned on the bottom 96 (see FIG. 1) rest on the two bottom parts 98 and 100 and cover up partly the gap-like space 104 (see FIG. 2) remaining between the two bottom parts 98 and 100.

When the bottom 96 is lowered, the lower face of the lower-most copy of the stack 120 positioned on the bottom, therefore, gets very soon into contact with the film tape 106 and pulls the film tape 106 along as it continues its lowering movement, the film tape being wound off the rollers 108 (see FIG. 2) which turn in opposite directions.

The film tape 106 is supported by two supporting rollers 114 arranged at identical levels (see FIGS. 3*a* to 3*f*) in such a manner that in the uppermost position of the bottom 96 the film tape 106 extends in the horizontal direction. The supporting rollers 114 are arranged for being displaced horizontally and are positioned in such a manner that the imagined extension lines of the sides of the stack 120 positioned on the bottom extend approximately tangentially to the two inner circumferential points of the supporting rollers 114 facing each other.

This leads to the result that, as can be seen best in FIG. 3*b*, the film tape 106 applies itself tightly about the bottom and the two opposite vertical side walls 122, 124 of the stack 120.

Two beams 64, 66 of a pressing device 62 are arranged below the film tape 106 and laterally of the lowering bottom 96. The two beams can be displaced horizontally, as indicated by arrows 68 in FIG. 1 and FIG. 3*b*.

The beams 64, 66 are guided on guide bearings, not shown in the drawing, and have their ends opposite the rotary basket 90 connected with a piston-and-cylinder unit.

The bottom (of which the part 100 can be seen in FIGS. 3*a* to 3*f*) is lowered to a position in which the uppermost copy of the stack 120 is positioned a certain distance below the two beams 64, 66 provided at equal levels (see FIG. 3*b*).

Once the bottom has reached this position, the lowering movement is stopped and the beams 64, 66 are moved across the stack 120. The arrangement of the beams 64, 66 is such that, viewed in the direction of displacement indicated by arrows 68, the beams 66 and 64 come to lie above the stack 120, left and right of the film tape 106, respectively (see FIG. 3*c* and FIG. 1).

Once the beams 64, 66 have been moved across the stack 120, the bottom 96 is lifted again by means of the rods 102 until the upside of the uppermost copy of the stack 120 abuts against the bottom face of the two beams 64 and 66. The upward movement of the bottom 96 is stopped when the stack 120 which is compressed between the beams 64, 66 and the bottom parts 98 and 100 has reached a predetermined pressure. This pressure is monitored by pressure gauges not shown in the drawing which are connected with the drive of the rods 102 and which act to stop the rods in the respective position when a predetermined pressure has been reached so that the stack 120 is retained in that compressed condition which is indicated in FIG. 1 by the broken lines and which corresponds to the position illustrated in FIG. 3*d*.

At both sides 122, 124 of the stack 120, sealing rams 118 are provided between the beams 64, 66, at the same level as the latter, which rams 118 can be displaced horizontally as indicated by arrows 70 in FIG. 1 and FIG. 3.

By moving the two sealing rams 118 inwardly, the film tape 106 is pulled across the upside of the stack 120. The sealing rams 118 meet at approximately the middle of the stack 120 for closing and sealing together the loop 76 of the film tape 106 formed about the stack 120. This operation will be described hereafter in more detail with reference to another embodiment of the invention, in connection with FIGS. 5 to 8. The condition in which the two sealing rams 118 occupy the closed position at the middle of the upside of the stack 120 is illustrated in FIG. 7.

When the loop 76 has been sealed and separated from the remaining film tape 106, the latter is retracted upwardly, due to the returning moment of the rollers 108 (see FIG. 2) where it remains stretched in horizontal position across the supporting rollers 114. This position is illustrated in FIG. 3*e* where the separating point has been marked by reference numeral 121.

After the loop 76 has been sealed and separated, the sealing rams 118 are retracted to both sides; the bottom is lowered slightly so that the beams 64, 66 resting on their upside can be lifted off the latter and retracted laterally.

Now, the stack 120 is finished and ready for being pushed upon a conveyor belt 74 arranged behind the rotary basket 90, as viewed in the direction of arrow 72 (see FIG. 1). The bottom 96, i.e. the partial bottoms 98, 100, are arranged at the same level as the upper surface of the conveyor belt 74 so that the finished stack 120 can be pushed upon the conveyor belt 74 for example by means of a slide moving in the direction of arrow 72.

The stack 120, with the loop 76 wrapped around, is then carried off in the direction indicated by arrow 78, towards its point of destination.

While the stack is carried off, the bottom returns to its uppermost position slightly below the base plate 92, as shown in FIG. 3f, and is now ready for receiving another partial stack 38 formed in the meantime in the partial stack-forming device 31.

Due to the U-shaped arrangement of the loading device 20, the stacking device 30 and the conveyor belt 74, the packaged copies are returned approximately to the same, although a little lower position where they had been introduced originally into the packaging device 10. This U-shaped arrangement permits extremely rational and place-saving packaging, with the feeding and discharging positions for the copies, which may be operated by hand, being arranged at the same position. This means that if books or magazines are to be packaged, for example, in small packages of twenty to thirty copies, for example for book shops or newspaper boys, a single person will be sufficient for picking the copies up from a supply container, positioning them individually on the conveyor belt 14 of the loading device 20 and removing the finished packages from the conveyor belt 74 at the end of the packaging process, at substantially the same, merely a little lower position.

By giving the conveyor belts 14 and 74 an inclined arrangement, these operations can be carried out at approximately the same levels at one and the same position.

Another embodiment of the packaging device and the method according to the invention is illustrated in FIGS. 4 to 8.

The constructional design of the rotary basket 90, i.e. with the base plate 92 and the bottom provided beneath the latter and consisting of the two partial bottoms 98 and 100, is the same as described in connection with FIGS. 1 to 3 so that the same reference numerals are used for identical components. The bottom parts 98, 100 are again held in position by rods 102 which are passed through the base plate 92 and guided in the latter on slide bearings not shown in the drawing.

The distance between the two end faces of bottom parts 98, 100 facing each other and defining the space 104 corresponds, as described before, to the width of the film tape 106 which is equal to approx. 6 cm in the embodiment illustrated in FIG. 4.

The diagrammatic side view of the rotary basket 90, as shown in FIGS. 5 to 8, corresponds to the view in the direction of arrow 72 in FIG. 1. The angle rails 103 hold the copies positioned on the bottom 96 and on the partial bottom 100 illustrated in FIGS. 5 to 8 by the four corner points of the stack 120 so that they cannot get dislodged in the horizontal direction. As has been described before, the angle rails 103 can be displaced in order to adapt them to the respective copy size and in order to enable the finished stack 120 to be ejected upon completion of the packaging process.

In the case of the design illustrated in FIGS. 5 to 8, the film tape 106 is again guided on supporting rollers 114 which are mounted for horizontal displacement, as has been described before.

Contrary to the design described before, in connection with FIGS. 1 to 3, the lowering movement of the bottom 96 is effected by lowering a pressing ram 116 upon the upper face of the uppermost copy 110 (see in particular FIG. 4). The partial stack-forming device 31 (see FIG. 1), or rather their parts 32, 33, of this design can be moved apart in the direction of arrows 34, 35 until the pressing ram 116 can be placed upon the stack 120 positioned in the rotary basket 90.

The pressing ram 116 comprises two parallel rails 117 extending in the direction of the film tape 106 (see FIG. 4) which act to compress the stack 120 between the rails 117 and the bottom parts 98, 100 when the pressing ram 116 is placed on the stack.

The rails 117 are spaced a distance at least equal to the spacing between the end faces of the bottom parts 98 and 100. This prevents the stack 120 from bending and ensures in addition, as will be described below, that the area on top of the uppermost copy 110 opposite the area of the bottom face of the lowermost copy 112 which faces the film tape 106 is kept clear. This means that here again the area of the stack 120 about which the film tape 106 is to be wrapped around, is freely accessible.

Figure 6:
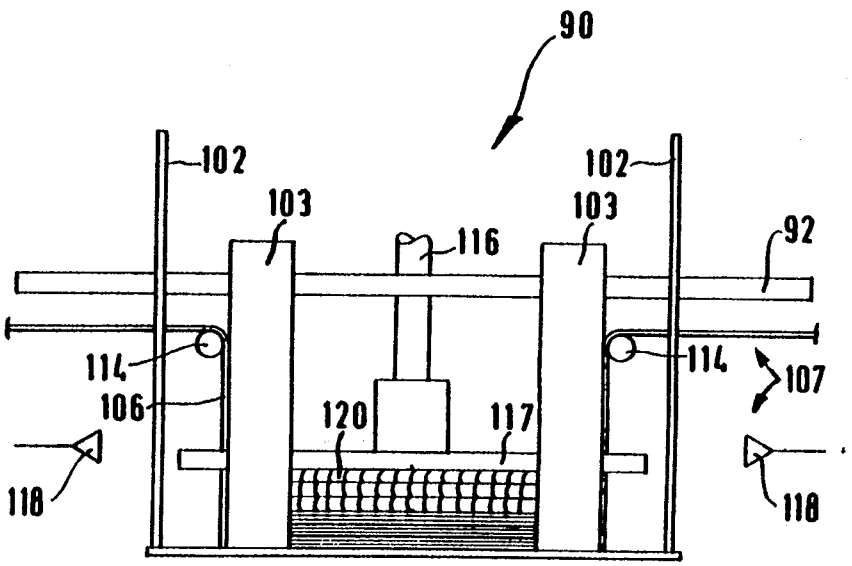
Figure 5:
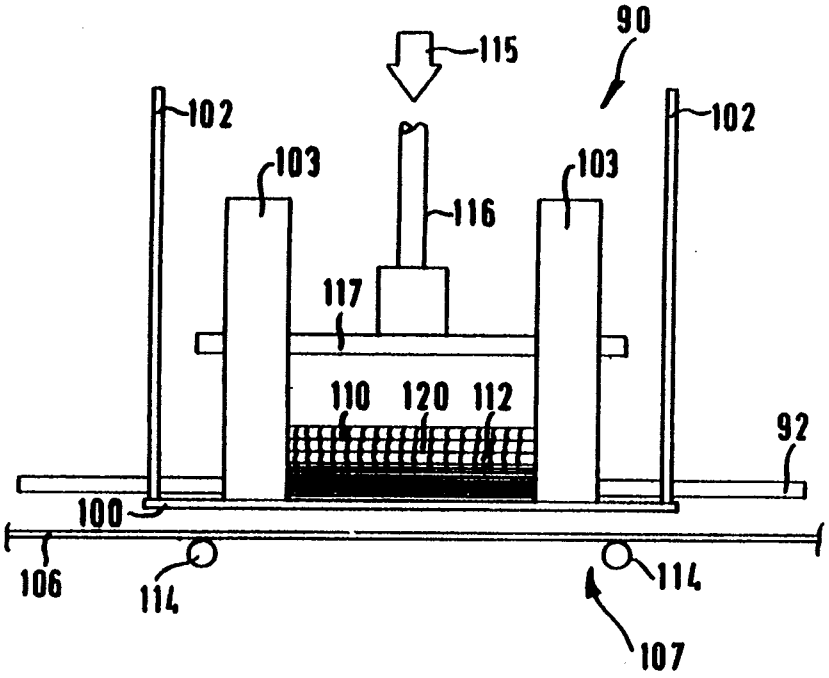
Figure 8:
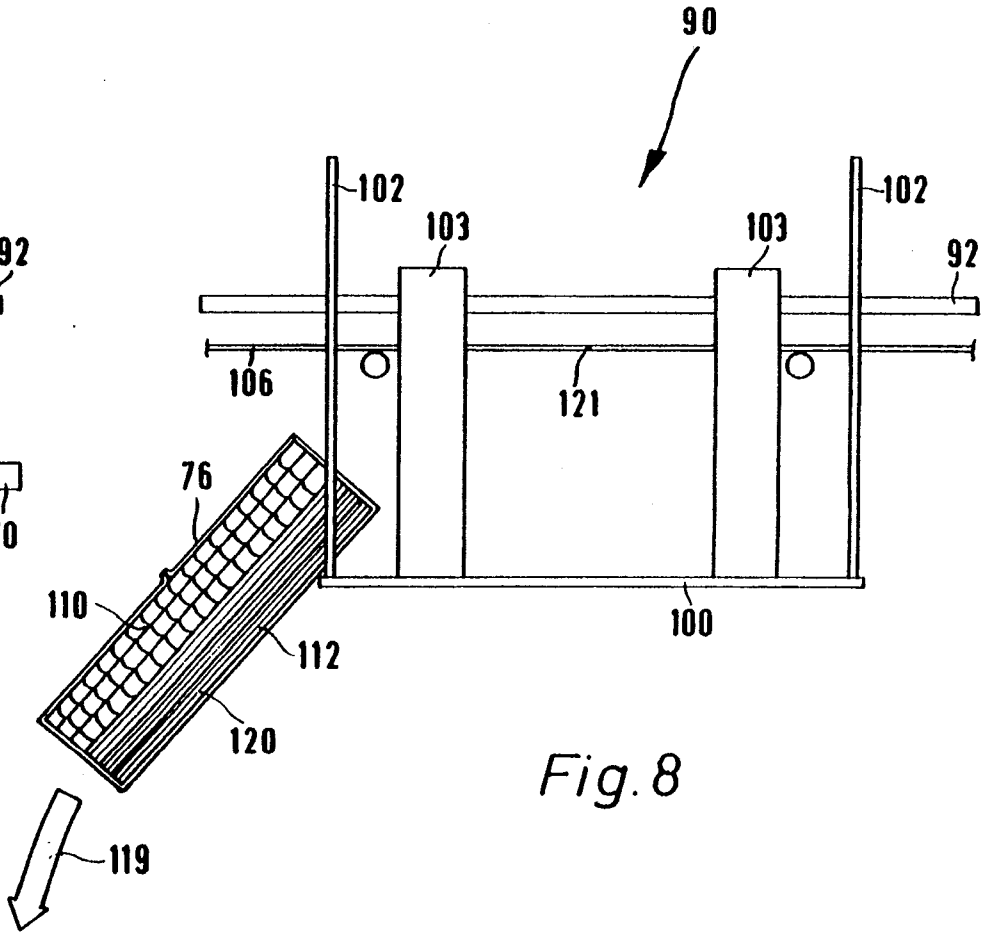
Figure 7:
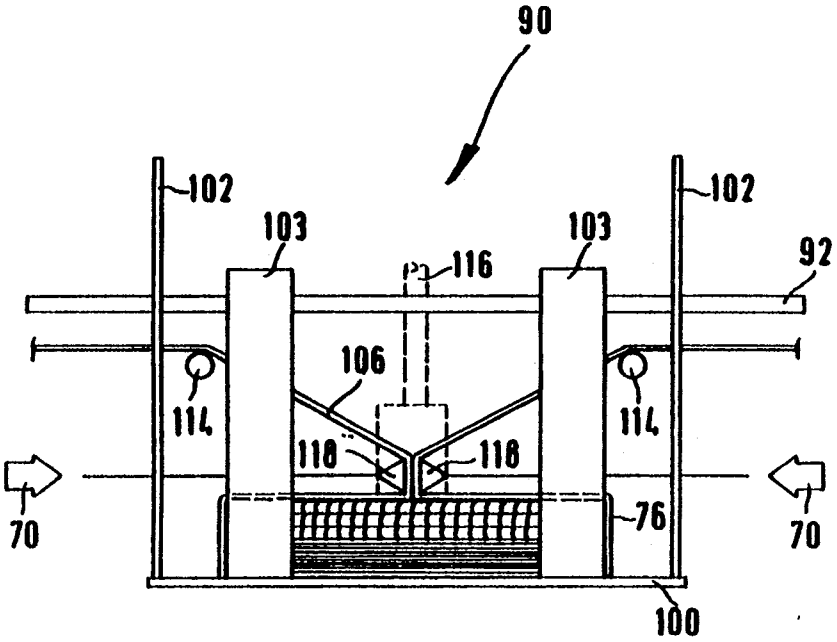

For lowering the bottom 96, or the partial bottoms 98 and 100, the pressing ram 116 which has been placed upon the uppermost copy 110 is advanced whereby the stack 120 is lowered into the film tape 106, as described before, and the latter is wrapped around the bottom and the lateral areas of the stack, as shown in FIG. 6.

The lowering movement of the pressing ram 116 is continued until the ram occupies a position at the same level as the sealing rams 118 arranged on both sides (see FIG. 6). The rods 102 are connected with returning means not shown in the drawing, due to which the rods tend to pull the bottom in upward direction.

This returning force can be selectively adjusted to ensure that the stack 120 is compressed between the rails 117 and the bottom parts 98, 100 at a predetermined pressure.

The two sealing rams 118 moving across the stack from the two sides pull the film tape 106 across the upper face of the stack 120 and meet at the middle of the stack (see FIG. 7) where they seal together the portion of the film tape 106 clamped between the sealing rams 118. Thereafter, the loop 76 wrapped tightly around the stack 120 is separated from the remaining film tape 106; the latter returns to its upper horizontal position, as described before, and the separating point 121 can be seen, as described before.

Now, the finished stack 120 can be either pushed upon a conveyor belt 24, as shown in FIG. 1, or discharged laterally from the bottom part 100 or 98, as indicated by arrow 119.

To this end, the pressing ram 116 is lifted to release the finished stack 120. In addition, the rods 102, or rather their return means, are blocked for this purpose. The bottom then returns to its uppermost position, shortly below the base plate 92, ready to receive a new partial stack 38 from the partial stack-forming device 31.

We claim:

1. Device for packaging preferably folded, glued or stitched copies of printed matter, comprising:

loading means for receiving said copies which arrive from a preceding station;

stacking means for receiving and for holding a stack of said copies, said stacking means follows said loading means and said stacking means are provided with lateral guides by which said stacks are held in such a position so that they cannot get dislodged horizontally; and banding means for banding said stacks with a banding element, said banding means is arranged immediately below said stacking means, wherein said stacking means comprises a bottom which is adapted for being lifted and/or lowered vertically and on which bottom the said copies can be stacked, said bottom is provided with an opening exposing at least that bottom area of a lowermost copy of the said stack where said banding element is to be applied, said stacking means being provided with a base plate that can be turned horizontally by 180° and which accommodates the said bottom, for rotation therewith.

2. Device according to claim 1, wherein said bottom is provided with two level-equalizing bottom parts held in place by carrier means mounted for vertical adjustment in the said base plate.

3. Device according to claim 2, wherein said bottom can be lowered by means of a pressing device adapted for being applied upon an uppermost copy of the said stack.

4. Device according to claim 3, wherein said pressing device exerts pressure upon the said stack by means of two rails of a pressing ram extending in parallel to the said stack.

5. Device according to claim 1, wherein said banding element is closed tightly by means of two closing rams arranged laterally of the said stack and adapted for moving across the top of the said stack.

6. Device according to claim 1, wherein said lateral guides comprise movable angle rails on the said bottom for defining the corners of a square stack.

7. Device according to claim 1, wherein said bottom can be lowered to a point sufficiently low to enable a pressing device arranged laterally thereof to be moved across the top face of an uppermost copy of said stack, whereafter the said bottom can be lifted to a position where the respective stack is held between the advanced pressing device and the said bottom, at a predetermined pressure, and wherein said banding element is closed in this compressed condition of the said stack.

8. Device according to claim 7, wherein said pressing device comprises two horizontally movable beams which extend in parallel to, and on both sides of the said banding element to be applied on the upper face of the said stack.

9. Device according to claim 1, wherein said bottom is connected via four vertical rods with said loading means, said rods being provided with a drive and which form the corners of a rectangle, said loading means ending at one side of said rectangle and the said copies being transferred from said loading means into a partial stack-forming device provided approximately at the same level and above the said stacking means thereby forming partial stacks of said copies whereafter partial stacks being stacked within the partial stack-forming device are deposited by the said partial stack-forming device on the bottom of said horizontally turnable base plate of said stacking means.

10. Device according to claim 1, wherein said banding element is supported on two horizontally adjustable supporting rollers which can be adjusted in such a manner that vertical tangents to two opposite inner circumferential points of the said supporting rollers extend along the lateral faces of the stack to be packaged.

* * * * *